United States Patent [19]

Mochizuki et al.

[11] Patent Number: 4,935,945

[45] Date of Patent: Jun. 19, 1990

[54] SYSTEM FOR EXPOSING X-RAY FILM TO X-RAYS, TO ADEQUATE DENSITY

[75] Inventors: Seiji Mochizuki; Hisatoshi Aoki; Seiichi Nishizuka, all of Ootawara, Japan

[73] Assignee: Kabushiki Kaisha Toshiba, Kawasaki, Japan

[21] Appl. No.: 338,338

[22] Filed: Apr. 13, 1989

Related U.S. Application Data

[63] Continuation of Ser. No. 921,132, Oct. 21, 1986, abandoned.

[30] Foreign Application Priority Data

Oct. 22, 1985 [JP] Japan ..... 60-236799
Oct. 31, 1985 [JP] Japan ..... 60-242652

[51] Int. Cl.[5] ..... H05G 1/42
[52] U.S. Cl. ..... 378/97; 378/108
[58] Field of Search ..... 378/97, 108; 250/368, 250/363 R, 361 R, 277, 483.1

[56] References Cited

U.S. PATENT DOCUMENTS

| | | | |
|---|---|---|---|
| Re. 28,451 | 6/1975 | Spleha et al. | 250/227 |
| 2,993,123 | 7/1961 | Ball | 250/368 |
| 3,444,378 | 5/1969 | Cibula et al. | 250/363 |
| 3,717,762 | 2/1973 | Grenier et al. | 250/227 |
| 3,717,763 | 2/1973 | Tanaka et al. | 250/361 R |
| 3,752,991 | 8/1973 | Slagle | 378/97 |
| 3,944,835 | 3/1976 | Vosburgh | 250/368 |
| 3,954,546 | 5/1976 | Aurenz | 350/96.24 |
| 4,075,483 | 2/1978 | Tancrell et al. | 250/368 |
| 4,376,566 | 3/1983 | Blackington | 250/227 |
| 4,409,476 | 10/1983 | Löfgren et al. | 250/368 |
| 4,467,208 | 8/1984 | Müller et al. | 250/483.1 |
| 4,540,293 | 9/1985 | Shores | 374/130 |
| 4,562,586 | 12/1985 | Honda et al. | 378/108 |
| 4,566,115 | 1/1986 | Brühr et al. | 378/97 |
| 4,599,711 | 7/1986 | Cuomo | 250/227 |
| 4,675,526 | 6/1987 | Rogers et al. | 250/363 R |
| 4,739,168 | 4/1988 | Aoki | 250/368 |
| 4,749,864 | 6/1988 | Sciamanda et al. | 250/363.01 |

FOREIGN PATENT DOCUMENTS

| | | |
|---|---|---|
| 0125349 | 11/1989 | European Pat. Off. . |
| 2918905 | 11/1979 | Fed. Rep. of Germany . |
| 2516338 | 5/1983 | France . |

*Primary Examiner*—Janice A. Howell
*Assistant Examiner*—John C. Freeman
*Attorney, Agent, or Firm*—Oblon, Spivak, McClelland, Maier & Neustadt

[57] ABSTRACT

In a system for exposing X-ray film to X-rays, to adequate density, X-rays emitted from a X-ray tube and passing through an object are incident on a X-ray film through a X-ray pickup device. A X-ray pickup device having a plurality of pickup fields comprises an intensifying screen for converting X-rays into light rays. In each of the pickup fields, a bundle of optical fibers are extended and end faces of the fibers are so arranged as to occupy each of the pickup field with segment pickup field of the optical fibers. The optical fiber bundles are optically coupled to photodetectors, respectively so that light rays are converted into electrical signals.

7 Claims, 4 Drawing Sheets

SYSTEM FOR EXPOSING X-RAY FILM TO X-RAYS, TO ADEQUATE DENSITY

This application is a continuation of application Ser. No. 921,132, filed on Oct. 21, 1986, now abandoned.

BACKGROUND OF THE INVENTION

This invention relates to a system for exposing X-ray film automatically to X-rays, to an adequate density, and more particularly, to an arrangement for detecting X-rays in the system.

Generally, in a system for exposing an object with X-rays, it is required to expose an X-ray film, to an appropriate density, with X-rays transmitted through the object. Therefore, an X-ray diagnosis apparatus is provided with means for exposing the X-ray film with X-rays, automatically to an appropriate density. In this automatic X-ray exposure means, the X-rays transmitted through an object are detected, and when the detected value, i.e., the total quantity of X-rays, reaches a predetermined value, exposure of the object to X-rays is stopped, whereby adequate exposure of the X-ray film is obtained. In such an automatic X-ray exposure system, an intensifying screen, for converting the X-rays into light rays, is located between the object and X-ray film, and a light-transmission device for transmitting the resultant light rays to a light detector, i.e., a photoelectron multiplier (hereinafter referred to as a multiplier) is provided between the light detector and an area in which X-rays, i.e., light rays, are to be picked up (i.e., a light-pickup field).

As the light-transmission device, a light transmission plate made of acrylic resin is used. Light rays incident on the acrylic resin plate and transmitted through this plate by random reflection, are detected by the photomultiplier. When the integral of the detected signal reaches a predetermined value, it is determined that the X-ray film has been adequately exposed, and exposure is stopped.

When using the acrylic resin plate as the light-transmission device, the following problems arise:

With the acrylic resin plate, the light transmissivity is not so satisfactory. Therefore, random reflection of light rays on the surface of the acrylic resin plate is utilized for light transmission. For this reason, the light-transmission efficiency is inferior. This means that it is necessary to position the photomultiplier in the vicinity of the acrylic resin plate. The thickness of the detector as a whole is thus increased, which constitutes a significant drawback when assembling the detector in an X-ray diagnosis apparatus. Furthermore, usually, the greater the distance to the photo-detector, the greater the attenuation of the light signals. Therefore, various contrivances are required for obtaining uniform detection efficiency in the light-pickup field.

SUMMARY OF THE INVENTION

An object of the invention is to provide an apparatus for exposing an X-ray film, to an adequate density, to X-rays, which apparatus is provided with an arrangement for detecting X-rays, which permits light rays converted from X-rays in pickup areas for detecting X-rays, to be picked up uniformly, which permits the picked-up light rays to be transmitted to the light detector with as little attenuation as possible, and which can be readily assembled in the system.

According to the present invention, there is provided a system for exposing an X-ray film to X-rays, to adequate density, comprising:

means for generating X-rays;

an X-ray film to be exposed to the X-rays having passed through an object;

a converting member situated between said object and X-ray film, for converting X-rays into light rays;

an optical fiber bundle located at said converting means, at a predetermined position thereof, and extending to the outside thereof, a plurality of optical fibers of said optical fiber bundle defining the light-pickup field on said converting member, each of said optical fibers having an end face on which light rays are incident, said end face having an effective pickup segment area capable of effectively transmitting light rays incident in this range, said end faces being disposed in said light-pickup field such that its surface area is substantially occupied by effective pickup-segment areas of optical fibers of said optical fiber bundle;

photo-detecting means for detecting light rays transmitted through said optical fiber bundle and generating detection signals; and means for integrating detection signals, to compare the integral with a reference level, and for deenergizing said X-ray generation means when a reference level is reached by said integral.

According to the present invention, there is also provided an apparatus for exposing an X-ray film, to an adequate density, to X-rays having been transmitted through an object, this apparatus comprising:

means for generating X-rays;

an X-ray film exposed to X-rays generated from X-ray generating means and transmitted through said object;

a member situated between said object and X-ray film, for converting X-rays into light rays;

a plurality of optical fiber bundles located at said converting member, at a predetermined position thereof, and extending to the outside thereof, a plurality of optical fibers of each of said optical fiber bundles defining pickup field on said converting member, a plurality of pickup field being defined by a plurality of optical fiber bundles;

a plurality of photo-detecting means for detecting light rays transmitted through each of said fiber bundles, for generating a detection signal;

means for providing each of said detection signals with a weight, according to the object to be photographed; and means for processing said detection signals provided with weights, said means adding said detection signals and integrating said detection signals with weights, in order to compare the integral with a reference level, and deenergizing the X-ray generation means when a reference level is reached by said integral.

DETAILED DESCRIPTION OF THE PREFERRED EMBODIMENT

Figure 1:
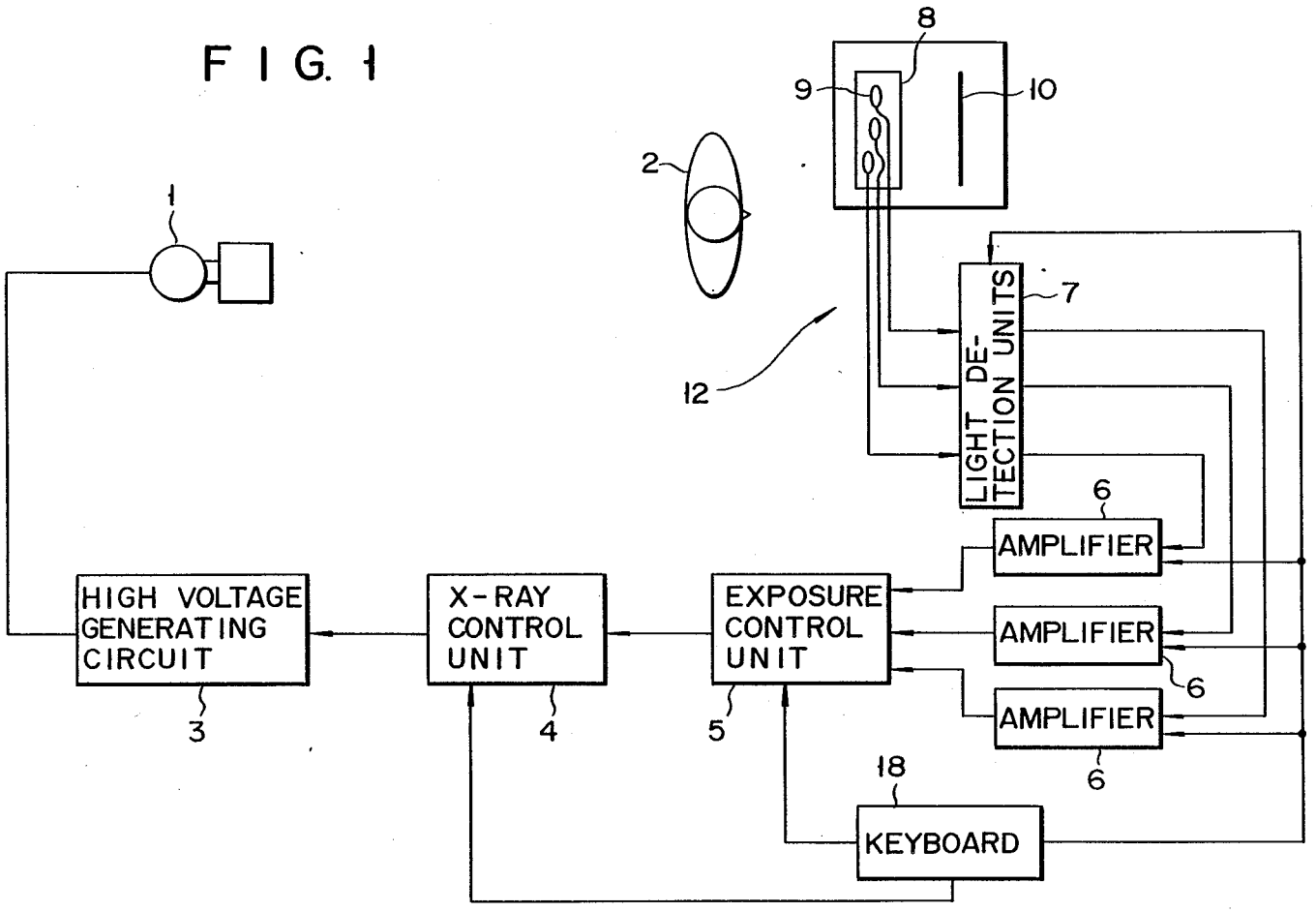
FIG. 1 is a schematic representation of an embodiment of the system for exposing an X-ray film to X-rays, to an adequate density.
Figure 2:
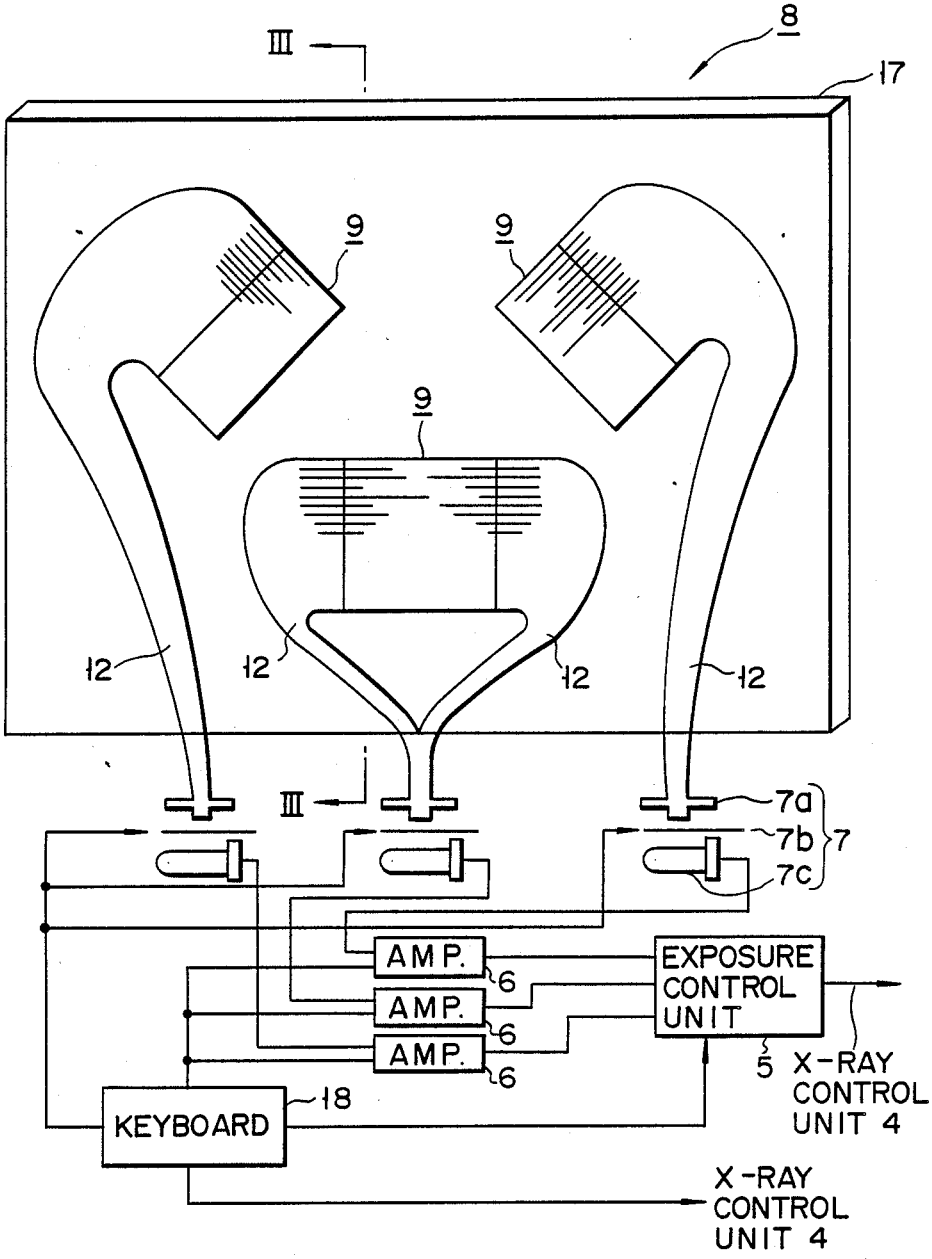
FIG. 2 is a schematic plan view showing an arrangement of the optical fiber bundle of an X-ray pickup device for converting X-rays shown in FIG. 1, into light rays.
Figure 3:
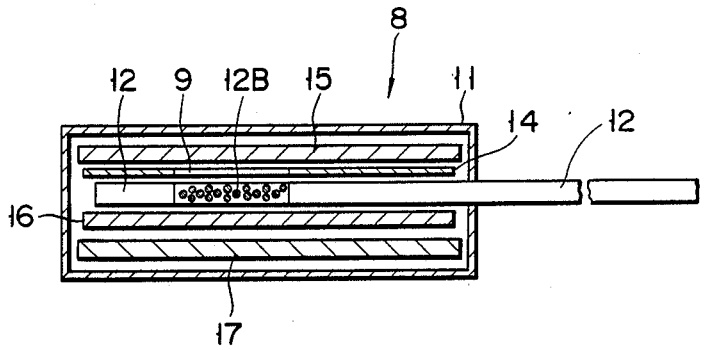
FIG. 3 is a schematic sectional view taken along line III—III in FIG. 2, showing the X-ray pickup device.
Figure 4:
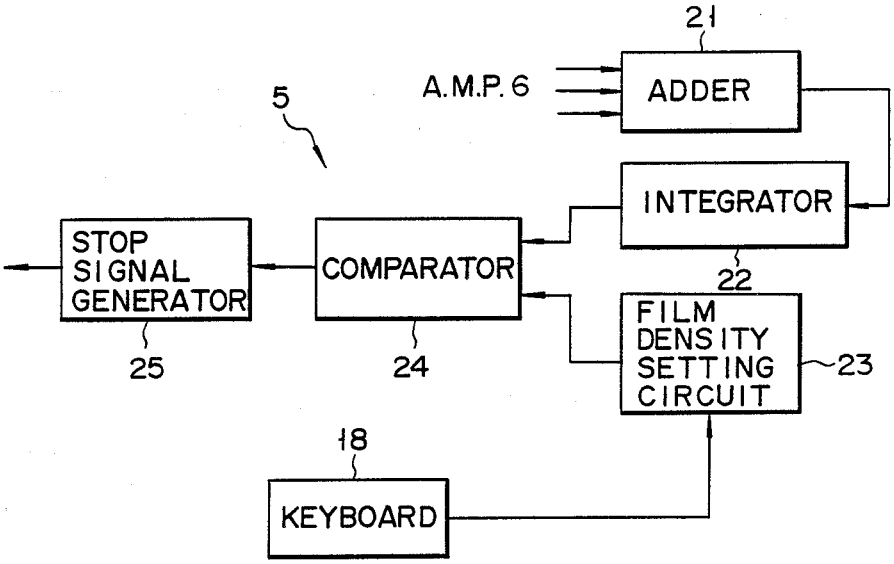
FIG. 4 is a block diagram showing an exposure control unit shown in FIGS. 1 and 2.

FIG. 1 shows an embodiment of the X-ray exposing system according to the present invention. In the system shown in FIG. 1, object 2 is located between X-ray tube 1 for generating X-rays and X-ray film 10. X-ray film 10 is exposed to X-rays transmitted through object 2, to form an X-ray image of object 2 on film 10. Between object 2 and X-ray film 10, an X-ray-pickup device or arrangement 8 is located, for converting X-rays into light rays. X-ray-pickup device 8, as is shown in FIG. 2, includes three pickup areas or fields 9 for picking up X-rays. Pickup fields 9 are disposed in pickup device 8 such that when taking a planar X-ray image of the brain of a man, opposite side pickup field 9 detects X-rays transmitted through the left and right lungs of the brain and the central pickup area 9 detects X-rays transmitted through the substantial center of the brain. FIG. 3 shows device 8. As is shown, it comprises housing 11, in which an intensifying screen, for converting X-rays into light rays, is situated such that it faces X-ray tube 1. Mask 14, which is opaque and has an aperture for defining pickup field 9, is provided in close contact with screen 15. Below mask 14, optical fiber bundles extend with one of their respective ends projected in pickup fields 9. Light rays, converted from X-rays by screen 15, enter the apertures defining the pickup field and are uniformly picked up by optical fiber bundles therein. Situated under optical fiber bundles 12, light-reflection film 16 is provided for reflecting light rays toward optical fiber bundles 12, for efficiently picking up light rays transmitted through pickup field 9. Substrate 12 is secured to the bottom surface of housing 11, in close contact with light reflection film 16 for securing optical filter bundles 12 to a predetermined position. As is obvious, housing 11, screen 15, mask 14, optical fibers 12, light reflecting film, and substrate 12 are made of a material capable of transmitting X-rays.

Optical fiber bundles 12, outwardly extending from X-ray-pickup device 8, are optically coupled to light-detection units 7. More specifically, connector 7*a* is provided at the other end of each optical fiber bundle 12. The end face of each optical fiber bundle 12 faces photomultiplier 7*c*, which detects light rays entering from the end face. The intermediate light path is provided with shutter mechanisms 7*b* for opening and closing it. Shutter mechanisms 7*b* are electrically connected to key board 18, via drivers (not shown). These shutter mechanisms are selectively operated on the basis of a command from keyboard 18, whereby the light path is selectively opened and closed, as is shown in FIGS. 1 and 2. Electron multiplier 7*c* is connected to amplifier 6, which in turn, is connected to exposure control unit 5. Amplifier 6 has a circuit arrangement whose the amplification factor is variable according to a command from keyboard 18. Each amplifier 6 generates a signal amplified with the same or different amplification factor, according to a command indicating a weight, i.e., according to the weight, such that the same or a different weight is imparted to a detection signal detected by the pickup area.

In exposure control unit 5, amplified signals imparted with the same or different weights are added together in adder 21, and the resultant sum output is integrated in integrator 22. The integral output of integrator 22 is supplied to comparator 24, to which is connected film density-setting circuit 23, in which an appropriate density designated by keyboard 18 has been stored, according to the film sensitivity and other parameters. The integral output is compared, in comparator 24, with a reference signal, depending on the film density stored in film density-setting circuit 23. The output from comparator 24 is supplied to STOP-signal generator 25. When the integral output reaches the predetermined level of the reference signal, that is, when X-ray film 10 is adequately exposed, comparator 24 is generated from zero level comparison output. According to this zero level comparison output, STOP-signal generator 25 supplies a STOP signal to X-ray control unit 4, and unit 4 causes high-voltage generating circuit 3, to stop application of high voltage power to X-ray tube 1. Thus, generation of X-rays from the X-ray tube ceases, and X-ray film 10 has thus been exposed at an adequate X-ray exposure level.

At the time of the start of X-ray exposure, X-ray control unit 4 causes high-voltage generating circuit 3 to generate a high voltage, to activate X-ray tube 1 in accordance with the START signal from keyboard 18.

Figure 5:
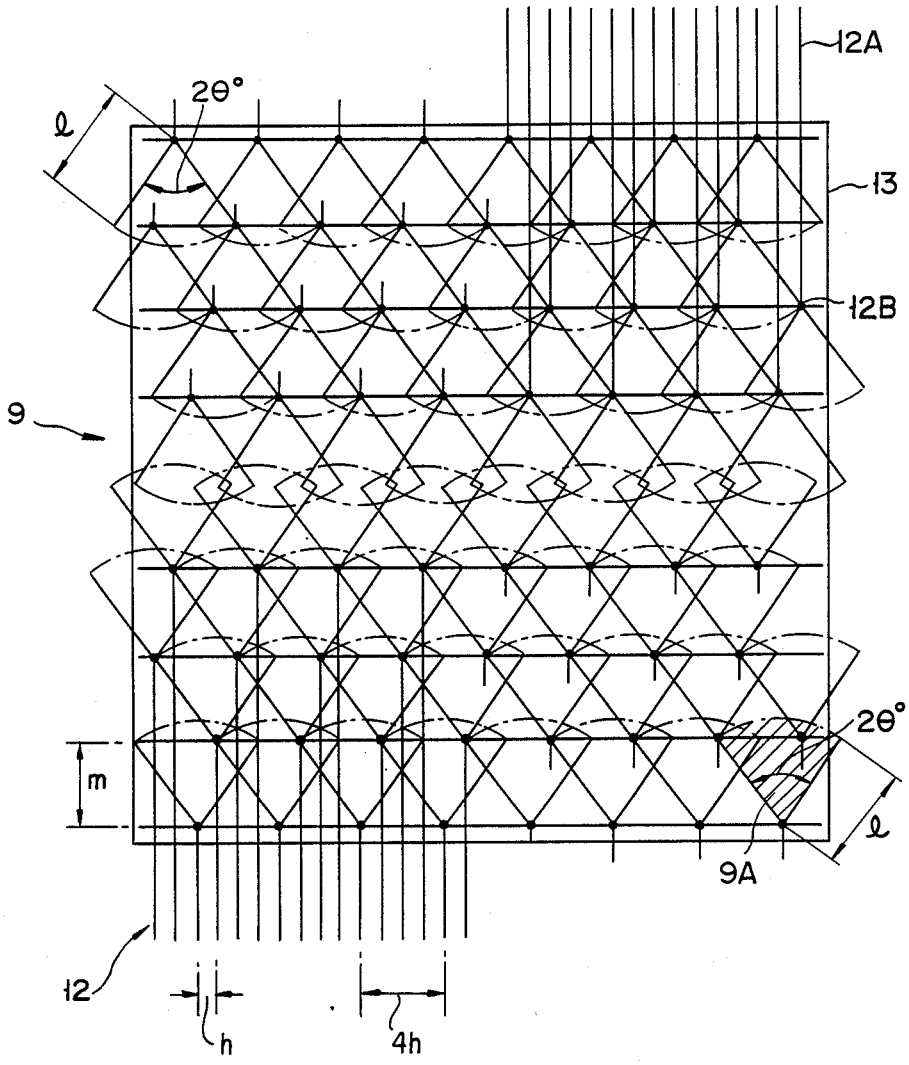
FIG. 5 is a plan view showing an example of the arrangement of optical fibers of the optical fiber bundle located in a pickup area.

Now, the arrangement of optical fiber bundles 12 in pickup areas 9 will be described, with reference to FIG. 5.

As is shown in FIG. 2, in opposite-facing pickup areas 9, optical fibers of optical fiber bundles 12 extend in one direction, and those of optical fiber bundles 12 extend in central pickup areas 9, in opposite directions. Further, in order that light rays are picked up uniformly in individual pickup areas 9, as is shown in FIG. 5, optical fibers 12A of optical fiber bundles 12 are arranged such that each pickup area 9 is substantially occupied by sector-like effective pickup segment areas 9A with optical fibers. Each effective pickup segment area 9A is defined to be a sector-like area with each side having a length l and subtending an angle of $2\theta$. Angle $2\theta$ is defined as the aperture angle, i.e., the light incidence angle, of the optical fiber. Light rays incident at this angle are directed and led into the optical fiber. Distance l is determined according to a type of a plastic fiber, the sensitivity of detection system and the characteristic of sensitive distribution thereof, and is preferably 10 mm. The number of optical fibers arranged in one pickup area is determined by the size of the pickup field and, more precisely, by the size of the pickup segment area ($2\theta_o \times l^2$). In the preferred embodiment shown in FIG. 5, the end faces of the optical fibers are arranged at intervals of m in a vertical direction of the pickup field and at intervals of 4 h in a horizontal direction perpendicular to the vertical direction. Each horizontal row of the end faces is shifted from the adjacent horizontal row by distance h, wherein the interval m, the distance h, and the interval 4h are defined by the following equation:

$$m = l \cos \theta,$$
$$h = l/3 \cdot \cos(\pi/2 - \theta),$$

and $$4h = l/3 \cdot \cos(\pi/2 - \theta) x 4.$$

The operation of the system having the above construction will now be described.

X-rays emitted from X-ray tube 1 are transmitted through object 2, to be incident on X-ray-pickup areas 9. In pickup field 9, X-rays are converted into light signals by screen 15. These light signals and light signals reflected from light reflection layers 16 are incident on light incidence end face 12B of each optical fiber 12A of plastic optical fiber group 12. The incident light signals are transmitted through plastic optical fiber group 12, to be projected from connector *7a* provided at the output end of optical fiber group 12.

The light signals transmitted through pickup areas 9 are converted into an electric signal by photomultiplier *7c* when shutter section *7b* is opened. The signal from photomultiplier *7c* is amplified by amplifier 6, for each pickup area 9. As a result, the X-ray detection efficiency can be varied for each pickup area 9. X-ray detection electric signals, having different X-ray detection efficiencies for each pickup area 9, are fed to exposure control unit 5. In unit 5, the detection signal is normalized, and when a value of exposure to the X-rays, corresponding to an adequate density, is reached by the integral of the detection signal, an X-ray exposure-stop signal is provided. When this signal is input, X-ray control unit 4 stops the emission of X-rays from X-ray tube 1. As has been shown, a plurality of pickup areas are provided with weights, and normalized values obtained from detection signals from these pickup areas are used to stop the emission of X-rays. Thus, it is possible to reduce fluctuations of the X-ray density when taking an X-ray image of the left and right lungs.

An example of normalization of the X-ray detection electric signal is shown below.

For example, the total integral of the X-ray detection electric signal analogous to X-rays corresponding to adequate density D=1.0, is referred to as A. The X-ray detection electric signal for each pickup field (three pickup fields, as is shown in FIG. 2, being assumed in this case) is controlled to fixed integral a by means of controlling amplifier a to which a command is supplied from the keyboard. At this time, a homogeneous acrylic phantom is used for object 2. Thus, a relation A=3a is set up. In this case, the X-ray detection efficiency of each pickup field 9 is the same.

When it becomes necessary to vary the X-ray detection efficiency of each pickup field 9, for example, when it becomes necessary to double the efficiency for the first pickup area, to set the second pickup field to one half the efficiency, and set the third pickup area to three times the efficiency, it is assumed that the amplification factor of amplifier 6 is set to be twice, one half, and three times, for the respective pickup areas. In this case, the X-ray detection electric signal from amplifier 6 is 2a, ½a, and 3a respective pickup areas 9. That is, the sum of X-ray detection electric signals fed to exposure control unit 5 is $$2a + \frac{1}{2}a + 3a = \frac{11}{2}a.$$

Since the density is adjusted to be 1.0 for the first time, 3a (=A), so that it is impossible to process the electric signals from individual amplifiers 6 having different X-ray detection weights. Accordingly, the signals must be normalized. First, the total integral 3a corresponding the density of 1.0 is divided by 11/2a to obtain normalization constant 6/11. The X-ray detection electric signal from each amplifier 6 is multiplied by this constant, to obtain $$2a \times \frac{6}{11} = \frac{12}{11}a,\ \frac{1}{2}a \times \frac{6}{11} = \frac{3}{11}a, \text{ and } 3a \times \frac{6}{11} = \frac{18}{11}a.$$

This signal is utilized as the integral of the X-ray detection electric signal corresponding to the exposure of X-rays for the optimum density of D=1.0. The sum of the normalized X-ray detection electric signals is $$\frac{12}{11}a + \frac{3}{11}a + \frac{18}{11}a = 3a\ (= A).$$

Thus, the ratio of the detection efficiencies of the individual pickup areas is held by setting the amplification factors of amplifiers 6 to be $$\frac{12}{11}a : \frac{3}{11}a : \frac{18}{11}a = 2 : \frac{1}{2} : 3.$$

A further case will be considered, in which the first pickup area 9 is blocked by light shutter 14 and is not used.

Now, a case will be considered, in which the X-ray detection efficiency is set to one half for the second pickup area, and to three times for the third pickup area. In this case, the X-ray detection electric signals from amplifiers 6 are ½a, 3a for respective pickup fields 9, and the sum of the X-ray detection electric signals fed to X-ray exposure control unit 5 is $$\frac{1}{2}a + 3a = \frac{7}{2}a.$$

Thus, the signal is normalized, and the integral 3a corresponding to a density of D=1.0 is divided by 7/2a to obtain a normalized constant 7/6. This constant is multiplied by X-ray detection electric signals from each amplifier, to obtain $$\frac{1}{2}a \times \frac{6}{7} = \frac{3}{7}a \text{ and } 3a \times \frac{6}{7} = \frac{18}{7}a.$$

The sum of the normalized X-ray detection electric signals $$\frac{3}{7}a + \frac{18}{7}a = \frac{21}{7}a = 3a\ (= A).$$

Thus, by setting the amplification factors of amplifiers 6 to 3/7a and 3/7a, the preset detection efficiency ratio can be maintained.

Detection signals with weights are generated for individual pickup areas, in the way as described above, in the following case, for instance. When an image of left and right lungs is formed on the film with an adequate density in the X-ray photograph to take a front image of the lungs, the detection signals are given with weights such that strong detection signals can be obtained from the left and right pickup fields, compared to the signals from the central pickup field. In the X-ray photograph of a side image of the breast, light images converted by the left and right pickup areas are not detected as detection signals in the photomultiplier.

Instead, only light rays converted by the central pickup area are taken out as detection signals. Further, in the X-ray photograph for taking a front image of the stomach, the detection signal obtained from the central pickup area is given a greater weight than that given to the left and right pickup areas.

In the system described above, optical fibers are used as a light-transmission device. It is thus possible to sufficiently reduce the thickness of X-ray-pickup device 8. Further, since plastic optical fibers 12 absorb less X-rays and have satisfactory light transmissivity compared to the acrylic resin plate used as the prior art light-transmission means, they are used for light transmission to light detector 7. Light detector 7 can be located a considerable distance from X-ray detector body 11. Thus, it is possible to reduce the mechanical restrictions when assembling the X-ray detectors in an X-ray diagnosis apparatus. This is very advantageous when mounting the X-ray detector in the X-ray diagnosis apparatus. Further, since plastic fiber group 12 has been utilized as light-transmission path, satisfactory light-detection efficiency can be achieved thereby improving the signal-to-noise ratio by means of control circuit system. In consequence, the performance of the automatic X-ray exposure apparatus can be improved.

The above embodiment of the invention is by no means limitative, and various changes and modifications can be made without departing from the scope of the invention.

For example, the shape and number of pickup areas 9 are not limited to those in the above embodiment, and they may be suitably varied according to the locality and purpose of photographing. Further, it is possible to use a semiconductor photosensor in lieu of the photomultiplier used for light detector 7.

As has been described in the foregoing, since, according to the present invention, optical fibers are used as light-signal transmission means, it is possible to assemble the light detector in an X-ray diagnosis apparatus, without any mechanical restrictions. Further, it is possible to freely vary the X-ray detection efficiency of each pickup field, to thereby reduce fluctuations of the X-ray image density. Thus, the present invention is useful, particularly for spectral X-ray photography.

What is claimed is:

1. A system for exposing an X-ray film to X-rays, to an adequate density, comprising:

means for generating X-rays;

an X-ray film disposed in an irradiation region irradiated by X-rays generated by said generating means to be exposed to X-rays having passed through an object;

a converting member situated between said object and X-ray film in said irradiation region, for converting X-rays into light rays;

an optical fiber bundle located at said converting member, at a predetermined position thereof, and extending therefrom to outside of the irradiation region, a plurality of optical fibers of said optical fiber bundle defining a light-pickup field on said converting member, each of said optical fibers having an end face on which light rays are incident, said end face having a fan-shaped effective pickup segment field capable of effectively transmitting light rays incident on said effective pickup segment field, the effective pickup segment field of each end face of each optical fiber being substantially the same size, said end faces being disposed in said pickup field such that the surface area of said pickup field is substantially occupied by effective pickup segment fields of optical fibers of said optical fiber bundle and such that the effective pickup segment fields are located substantially uniformly within the pickup field;

photo-detecting means disposed outside of said irradiation region for detecting light rays transmitted from the light-pickup field into the optical fibers within said irradiation region and through said optical fiber bundle to outside said irradiation region, and generating detection signals; and means for integrating detection signals, to compare the integral with a reference level, and for deenergizing said X-ray generation means when a reference level is reached by said integral;

wherein the effective pickup segment field of each optical fiber has a side length e and an aperture angle $2\theta$, the end faces of the optical fibers are arranged at intervals of m in a first direction of the pickup field and at intervals of 4h in a second direction perpendicular to the first direction, each of the arrays of the end faces arranged in the second direction is shifted from the adjacent array of the end faces arranged in the second direction by distance h, wherein the interval m, the distance h, and the interval 4h is defined by the following equation:

$$m = l \cos \theta,$$
$$h = l/3 \cdot \cos(\pi/2 - \theta),$$

and $$4h = l/3 \cdot \cos(\pi/2 - \theta) x 4.$$

2. The system according to claim 1, wherein said effective pickup segment fields of the optical fibers of said optical fiber bundle are defined as sector-like areas of $2\theta \times l_2$.

3. The system according to claim 1, which further comprises a substrate for supporting optical fibers, and a light reflection film located between said substrate and optical fibers.

4. An apparatus for exposing an X-ray film, to an adequate density, to X-rays having been transmitted through an object, said apparatus comprising:

means for generating X-rays;

an X-ray film exposed to X-rays generated from said X-ray generating means and transmitted through said object;

a member situated between said object and X-ray film, for converting X-rays into light rays;

a plurality of optical fibers bundles located in said converting member, at a predetermined position thereof, and extending to the outside thereof, a plurality of optical fibers of each of said optical fiber bundles defining pickup fields on said converting member, a plurality of pickup areas being defined by a plurality of optical fiber bundles;

a plurality of photo-detecting means for detecting light rays transmitted through each of said fiber bundles, for generating a detection signal;

means for providing each of said detection signals with respective given weights, according to the object to be photographed; and means for processing said detection signals provided with said given weights, said means adding and integrating said detection signals with weights, in order to compare the integral with a reference level, and deenergizing the X-ray generation means when a reference level is reached by said integral.

5. The apparatus according to claim 4, wherein said plurality of photo-detecting means each include a photo-detecting device for converting light rays into a signal, and a shutter mechanism situated between the photo-detecting devices, for selectively leading light rays from said optical fiber bundles to said photo-detecting devices.

6. The apparatus according to claim 4, wherein said signal-processing means includes amplifiers connected to said respective photo-detecting devices and having an amplification factor varied according to the weight to be attached, an adder for adding together signals from said amplifiers, an integrator for integrating addition signals from said adder, a comparator for comparing the integral signal, from said integrator, with a predetermined reference signal, and means for generating STOP-signals, according to the output of said comparator, to de-energize the means for generating X-rays.

7. The apparatus according to claim 6, wherein the amplification factor of said amplifiers is adjusted to a normalized value determined according to the given weight.

* * * * *